US005522111A

United States Patent [19]

Kelsay et al.

[11] Patent Number: 5,522,111

[45] Date of Patent: Jun. 4, 1996

[54] FINISHING TROWEL HANDLE

[75] Inventors: Curtis D. Kelsay, Springdale; Duane W. Woltjen, Fayetteville, both of Ark.; Kent D. Williams, Clinton, Mo.

[73] Assignee: Marshalltown Trowel Company, Marshalltown, Iowa

[21] Appl. No.: 352,321

[22] Filed: Dec. 8, 1994

Related U.S. Application Data

[63] Continuation-in-part of Ser. No. 25,622, Mar. 2, 1993, Pat. No. 5,327,612.

[51] Int. Cl.[6] ..... B05C 17/10; E04F 21/16

[52] U.S. Cl. ..... 15/235.4; 15/143.1

[58] Field of Search ..... 15/235.4, 235.8, 15/143.1, 245.1; 16/111 R, 116 R

[56] References Cited

U.S. PATENT DOCUMENTS

| | | | |
|---|---|---|---|
| 314,479 | 3/1885 | Richardson | 15/235.4 |
| 1,055,406 | 3/1913 | Mason et al. | 15/235.4 |
| 1,786,043 | 12/1930 | Troutner | 15/235.4 |
| 2,771,325 | 11/1956 | Brunson | 15/235.4 X |
| 2,934,936 | 5/1960 | Vernon | 15/235.4 |
| 3,095,594 | 7/1963 | Dornbos | 15/235.4 |
| 3,368,234 | 2/1968 | Edens, Jr. | 15/235.4 X |

FOREIGN PATENT DOCUMENTS

| | | | |
|---|---|---|---|
| 518514 | 3/1955 | Italy | 15/235.4 |
| 1076525 | 7/1967 | United Kingdom | 15/235.4 |

*Primary Examiner*—David Scherbel
*Assistant Examiner*—Patrick F. Brinson
*Attorney, Agent, or Firm*—McAndrews, Held & Malloy, Ltd.

[57] ABSTRACT

A finishing trowel comprised of a blade, a mounting and a handle, wherein the handle is hollow and has a square mounting hole for receiving a square mounting surface. A plastic handle is comprised of a durable inner core material and a grippable outer member. The handle's inner core includes deformable ribs which axially line the mounting hole and provide a secure, lash-free fit onto the mounting surface over a broader range of manufacturing tolerances for the parts. The handle also includes an endcap which cuts into and seals the endcap against an outer grippable material upon tightening of a flanged nut onto the mounting. A lip extends from the handle and encompasses a portion of the mounting to facilitate increased torque transfer from the handle to the mounting and blade. The replaceable handle can also be formed of other grippable materials such as wood.

43 Claims, 5 Drawing Sheets

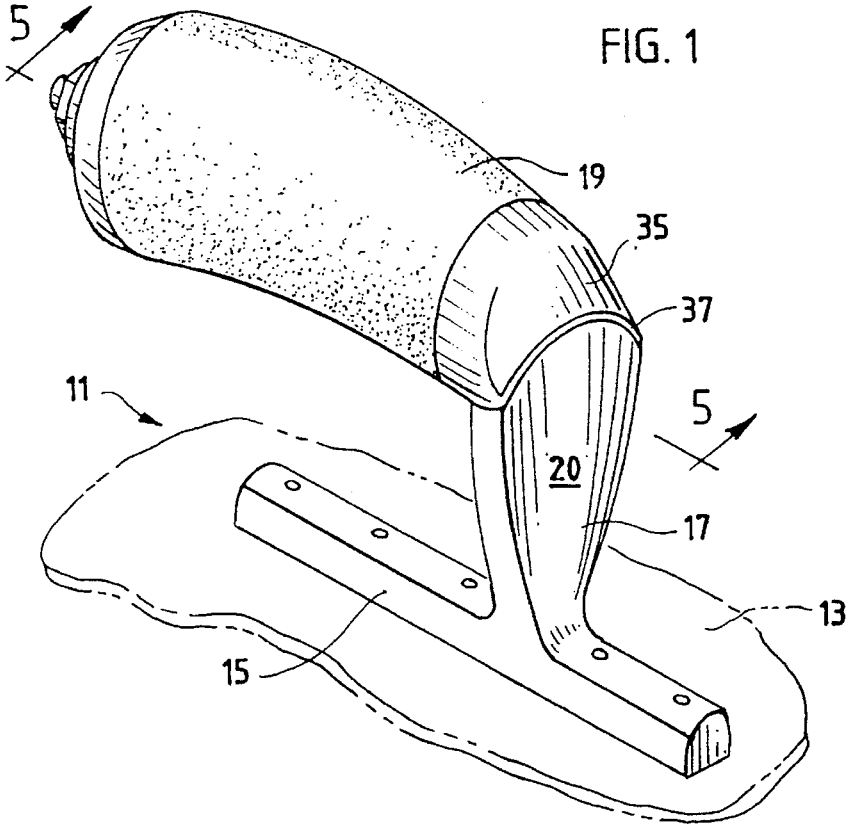
FIG. 1
FIG. 2
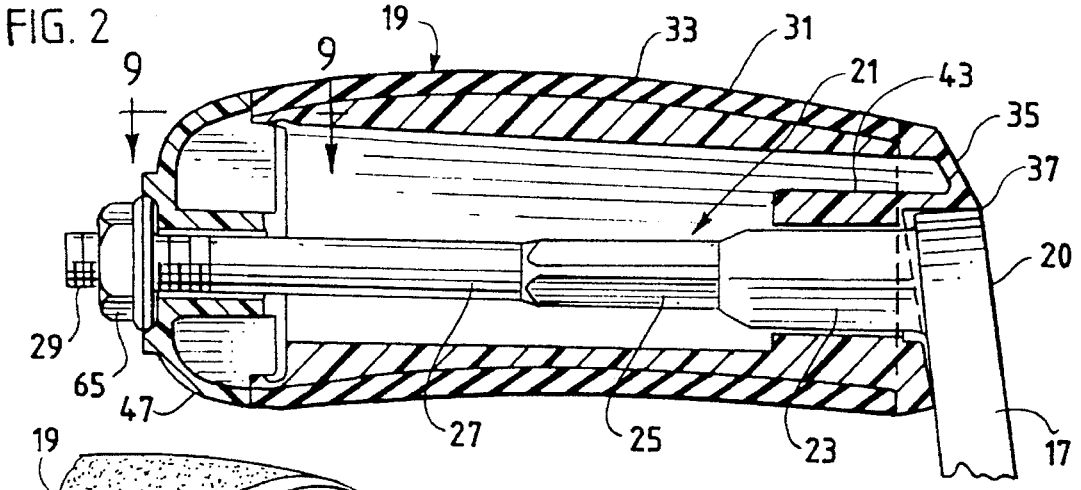
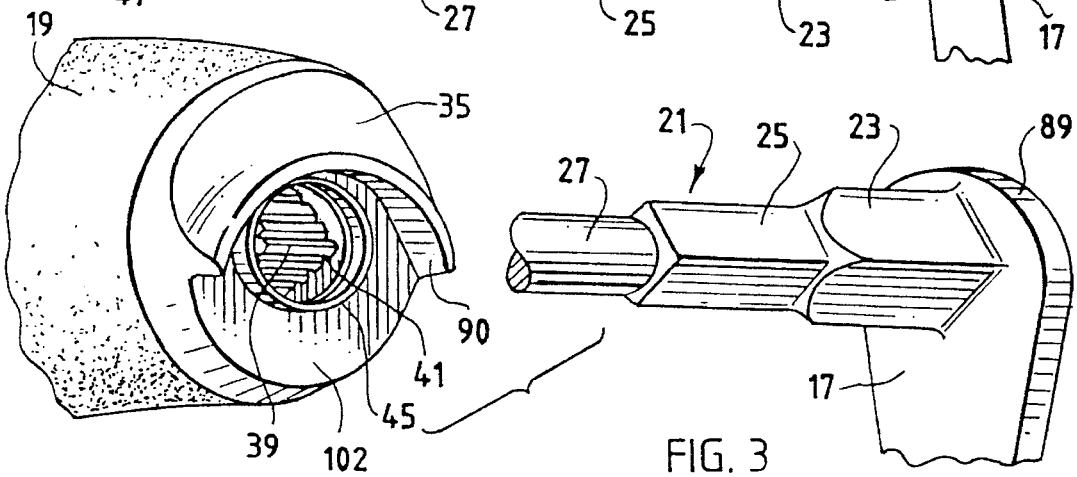
FIG. 3

FINISHING TROWEL HANDLE

CROSS-REFERENCE TO RELATED APPLICATION

The present application is a continuation-in-part of an allowed application of Curtis Dwight Kelsay, U.S. Ser. No. 08/025,622, filed Mar. 2, 1993 now U.S. Pat. No. 5,327,612 and issued Jul. 12, 1994. The entire disclosure of this application, including the drawings and appendices, are incorporated herein by reference as if set forth fully in this application.

BACKGROUND OF THE INVENTION

The present invention relates to a trowel handle and more particularly to a finishing trowel handle with a mounting and an interchangeable handle mounted thereto. The handle is angled and rounded at the front portion where the handle meets a post so as to provide a smooth, virtually flush transition between the post and the handle where the users thumb may be frequently placed.

A firm grip upon the handle of a trowel is advantageous to prevent the trowel from turning when troweling concrete or when its edge is being used for dozing concrete from one work area to another. When plastics such as glass-filled nylons, polyolefins, or wood are used for the handle, the low coefficient of friction of the smooth outer surface of the handle allows slippage of the trowel in the user's hand, particularly where the hand becomes wetted from perspiration or concrete.

The present invention's handle can be injection molded from two separate types of plastic, where an outer hand grip is molded from a thermoplastic rubber having a slightly soft, non-slip, rubber-like feel surface. This surface provides a favorable grippability to the handle, added ergonomic comfort for the user, and added aesthetic appeal to the handle's appearance. Furthermore, the inner part of the handle, as molded from a harder plastic, provides inner strength for mounting the handle and using the tool.

When trowels are used to spread concrete, the user tends to fully grasp the body of the handle for control of the angle of the trowel blade's working face presented to the work surface. The user's fingers and palm are prone to become chapped and may develop callouses wherever slippage or chafing occurs between the handle and the hand. A major factor promoting callousing of the hand is the presence of concrete. Concrete serves as an irritant by its abrasiveness as well as its chemical effect on the skin.

The present invention's inner core can be formed from polypropylene which provides a strong, durable, and resilient mounting surface. The polypropylene also provides a smooth, low friction area of transition from the body of the handle to the post where the thumb may rest. The friction of the polypropylene, relative to the friction of the outer hand grip and the post, can be controlled by varying the finish on the exposed portions of the inner core.

Alternatively, the entire handle can also be made from wood in the same exterior shape or other grippable, yet smooth materials which can be formed to have smooth and blended transition to the post.

Present finishing trowels often use injection moldable plastics, such as glass-filled nylons or polyolefins for the handle. However, when hollow plastic handles are used, watertight seals must be maintained around the joints in the component plastic parts because the complete tool is often submerged in water for cleaning. If water leaks into the handle's hollow cavities, then the weight advantage of a hollow structure may be reduced significantly. Often the manufacturing processes become complex and expensive to achieve the tolerances necessary for proper handle assembly with watertight seals.

The present invention provides a practical, ergonomic and effective solution which utilizes lightweight hollow handle cores and inexpensive sealing techniques for the components.

Additionally, injection molded handles are often non-replaceable as they are integrally molded onto the mounting. Heretofore, to be interchangeably replaceable, handles and their component parts and mountings, had to be made within exacting tolerances to achieve proper fit upon replacement. Also, replacement handles are often limited to one material which makes no provision for varied user preferences.

The present invention discloses replaceable parts which may be economically manufactured and interchanged without exacting tolerances to achieve a proper fit upon replacement. Additionally, alternative replacement materials may be used.

SUMMARY OF THE INVENTION

Therefore, it is an object of the present invention to overcome the deficiencies of prior art trowels which make use of solid plastic, metal, wood or other handle materials, or which make use of hollow materials with expensive or ineffective component part seals.

It is a further object of the present invention to provide a trowel handle as an interchangeable replacement part that can be manufactured less expensively and to less exacting tolerances.

It is a further object of the present invention to provide a trowel with a grippable, non-slip outer surface.

It is a further object of the present invention to provide a trowel with an angled and rounded smooth transition at the joint of the handle and the post where the user's thumb may be placed.

It is a further object of the present invention to provide an improved trowel in the combination of handle, mounting and blade.

These and other objects are achieved in a trowel having a replaceable handle with inexpensive parts and watertight seals, along with an angled and rounded smooth transition where the handle joins the post.

BRIEF DESCRIPTION OF THE DRAWINGS

FIG. 1 is a perspective view of a trowel embodiment of the present invention.

FIG. 2 is a cross-sectional view of the handle of FIG. 1 taken along 5—5 in FIG. 1.

FIG. 3 is an exploded view of the handle mounting, tang, and post and the unmounted trowel handle of FIG. 1.

DESCRIPTION OF THE PREFERRED EMBODIMENT

Figure 4:
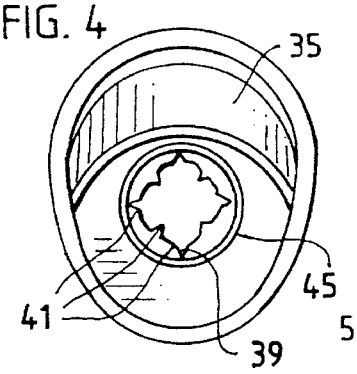
FIG. 4 is a front view of the unmounted trowel handle of the trowel of FIG. 1.

Referring to FIG. 1 and 2, a trowel 11 is constructed of a flat metal blade 13, a mounting 15, and a handle 19. The mounting 15 is comprised of a mounting rib 88, a post 17 extending upwardly from mounting rib 88 and supporting a tang 21 and a handle 19 in a manner described hereinafter. Post 17 is shaped with a smooth, cylindrically curved front surface 20. Mounting 15 is integrally formed with, or is otherwise secured to, the top surface of blade 13 in any conventional manner.

Referring to FIGS. 2 and 3, tang 21 extends laterally from post 17 and is disposed substantially parallel to and above the plane of blade 13. Mounting 15, as comprised of rib 88, post 17, and tang 21 are typically made of metal as one piece.

Tang 21 includes a proximal section 23, a middle section 25 and a distal section 27. Proximal section 23 is disposed adjacent to post 17 and has a square cross-section. The square cross-section allows more torque to be transferred from handle 19 to tang 21. Middle section 25 of tang 21 is reduced in thickness and likewise has a square cross-section. Distal section 27 is cylindrical in shape, terminating in a threaded portion 29.

The increased transfer of torque between handle 19 and tang 21 might also be achieved by proximal section 23 having any non-circular cross-sectional shape. For example, triangular, rectangular, hexagonal, octagonal, or any other non-circular geometric, or irregular, cross-sectional shape for proximate section 23 will provide superior torque transfer capabilities over circular cross-sectional shapes.

As shown in FIGS. 2 and 3, handle 19 includes a hollow inner core 31 and an outer grip member 33. The inner core 31 may be formed from polypropylene. The polypropylene forms a firm and durable, but resilient mounting surface. The polypropylene also provides for an outer lip 35 for contact with the users thumb whose surface friction can be controlled by varying the polypropylene surface finish for these exposed areas. A somewhat smooth outer lip 35 provides a lower coefficient of friction with the user's thumb when compared to the outer grip 33, thus permitting it to freely slide along the surface during manipulation of the trowel without chaffing drag. In the present embodiment, for example, the surface of outer lip 35 has a matt finish providing only slightly more friction than smooth polypropylene, because this finish is more aesthetically pleasing to consumers.

The outer grip member 33 can be molded from a thermoplastic rubber, e.g. Santoprene, having a slightly soft, non-slip, rubber-like feel surface. This material provides a higher coefficient of friction with the user's fingers and palm thus providing a more grippable and comfortable surface. While the Santoprene could extend over all exposed areas of the inner core 31, such coverage would add expense, lack aesthetic appeal, and retard the said relatively free movement of the thumb.

Inner core 31 has a tapered, arc-shaped lip 35 disposed at the proximal end of handle 19. Lip 35 is terminated flush with the front surface of post 17 to form a smooth transition region 37 (FIG. 1) between the handle's inner core 31 and post 17. This smooth transition is further facilitated by post front surface 20 curving convexly outward. It is preferred that front surface 20 is cylindrical in shape, rather than conical or compoundly curved, for ease in generating matching shape and dimension in manufacturing a smoothly transitioning mounting 15 and handle 19.

The arc-shaped lower surface 90 of lip 35 also encompasses the top surface 89 of post 17. Surface 89 is eccentric to the proximate section 23 of the tang thus allowing for greater torque transfer between the handle 19 and the mounting 15.

Referring to FIGS. 2, 3, and 4, inner core 31 includes a square shaped mounting hole 39 for receiving the proximate section 23 of the mounting tang in tight interference fit by means of the side surfaces of mounting hole 39 which include a plurality of raised, crushable ribs 41 extending along the axial length of mounting hole 39. Ribs 41 make frictional contact with the outer surface of proximal section 23 and are crushed or deformed as handle 19 is forced onto tang 21. Said crushable ribs 41 provide a means for achieving a secure preloaded lash free fit without the need for more exacting manufacturing tolerances or high assembly forces to have interchangeable handle parts.

As shown in FIG. 2, core 31 includes an inner extended section 43 for providing additional support to the core at the proximal end of the tang 21. Section 43 must be long enough to provide sufficient torque resistance to the tang 21, but short enough so as to maintain the weight advantages of the hollow inner core 31. The necessary length of section 43 varies with the type of material used for core 31. A stronger material allows for a shorter section 43. Alternatively, weaker and often less expensive, materials can be used for core 31 and yet still provide sufficient support by extending section 43. With the embodiment and materials shown, for example, the necessary length of section 43 was approximately 1.25 to 2 times the minimum cross-sectional dimension of mounting hole 39.

Referring to FIGS. 3 and 4, mounting hole 39 is surrounded by a raised annular crushable ring 45 which is crushed or deformed by the back of post 17 (Surface 100 in FIG. 11) upon mounting of handle 19 on tang 21. The crushing of annular ring 45 serves to seal the proximal end of hollow inner core 31 relative to post 17.

This mounting arrangement is also very resilent, particularly in plastic handles when the mounting connection between hole 39 and tang 21 in conjunction with surface 90 and surface 89 of FIG. 3 is torqued to the point of structural failure. For an overtorqued wooden handle, the mounting connection is most often permanently loosened thereby ruining the handle. However, overtorqued plastic handles often restore themselves sufficiently over time and become usable again due to the resiliency of the plastic and the mounting arrangement.

Referring again to FIG. 2, the handle 19 includes an endcap 47 which supports and seals off the distal end of the inner core 31. Endcap 47 is formed from the same material, or a harder material, as that of inner core 31.

Figure 5:
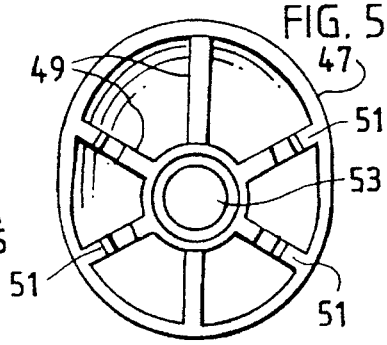
FIG. 5 is a front view of the endcap component of the trowel handle of FIG. 1.
Figure 6:
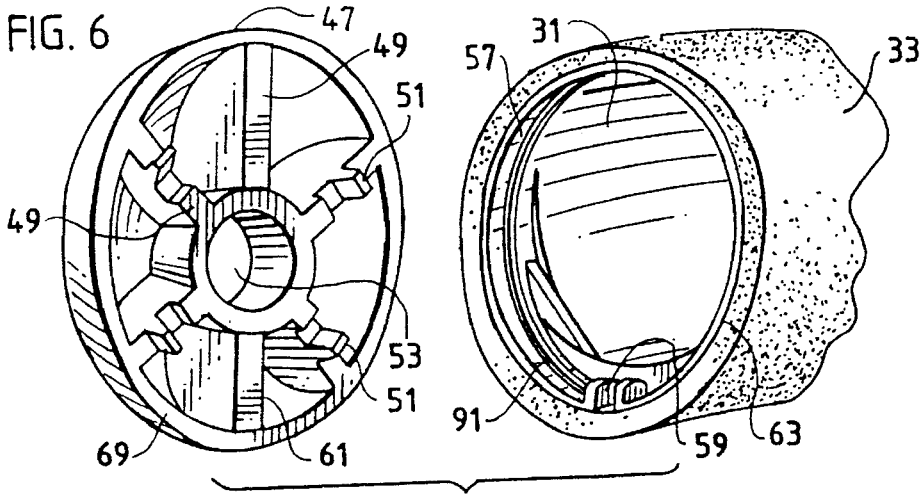
FIG. 6 is an exploded view of the unmounted handle endcap and the handle body of FIG. 1.

As shown in FIGS. 5 and 6, endcap 47 includes a plurality of ribs 49, a majority of which include a spring tab 51 extending outwardly from the rib. Endcap 47 also includes a through hole 53 for receiving the distal threaded portion 29 of tang 21.

Figure 7:
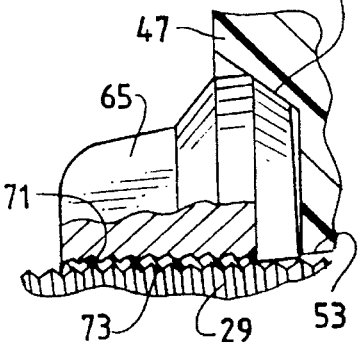
FIG. 7 is a cross-sectional view of the mounting tang threads distal to the post of FIG. 2.

Referring to FIGS. 6 and 7, the back of endcap 47 includes a tapered countersink 55 surrounding hole 53 to facilitate sealing of the flanged nut 65 against the outer grip member 33. The annular surface of nut 65 embeds into surface 55 as nut 65 is advanced on the threaded distal portion 29 of tang 21.

Referring to FIG. 6, to further facilitate mounting of endcap 16, inner core 31 includes a distal end region 57 which terminates in an annular rim 63 where inner core 31 is formed substantially thinner and thus is more easily deformable to pressure. End region 57 includes a guide slot 59 for receiving a guiding endcap rib 61. End region 17 also includes a radial channel 91 for receiving and frictionally engaging endcap spring tabs 51. The receipt of endcap spring tabs 51 into the radial channel 91 holds endcap 47 in place on the handle during the handle assembly procedure until said endcap can be secured by an end nut 65 threaded onto surface 29 of tang 21.

Figure 8:
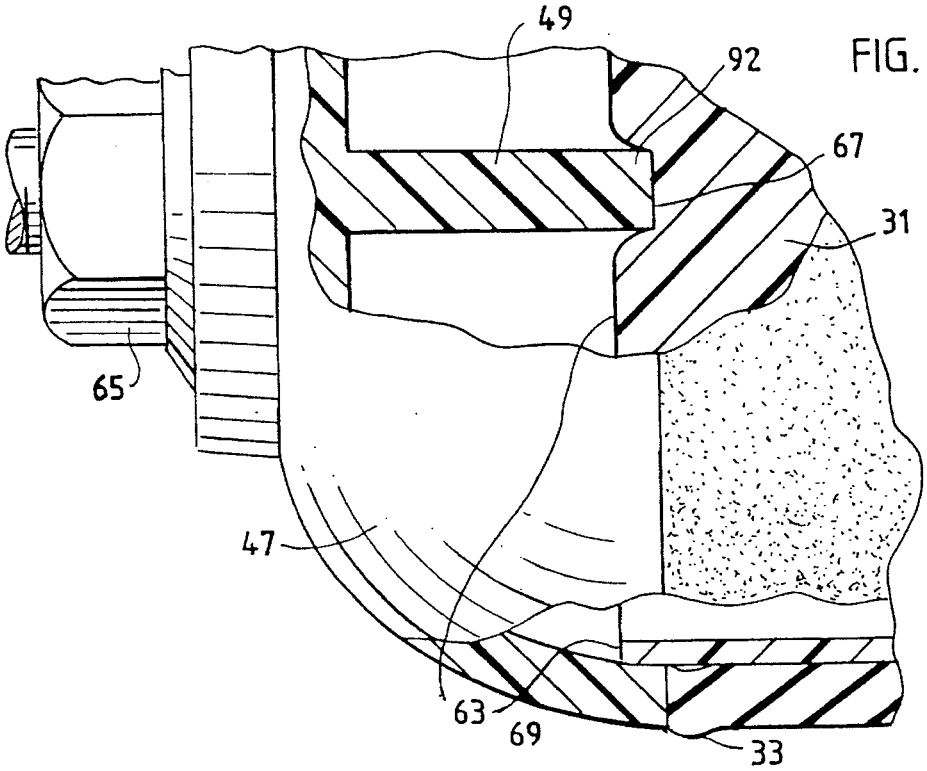
FIG. 8 is a partial cross-sectional side view of the mounted handle endcap of the trowel handle of FIG. 1.
Figure 9:
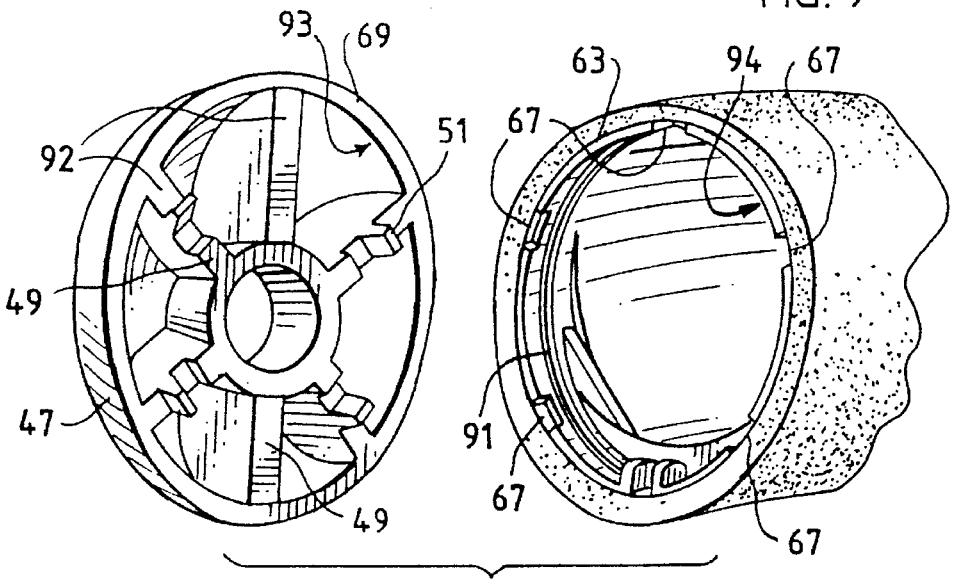
FIG. 9 is an exploded view of the unmounted handle endcap and the handle body of FIG. 1 showing the indentations caused by the ribs of the endcap in the handle body when tightened.

Referring to FIGS. 8 and 9, the tightening of endcap 47 onto mounting tang 21 forces rib contact regions 92 of the endcap to impress into and form indentations 67 in the thinner inner core material of annular rim 63. The inner diameter 93 of endcap outer wall 69 is larger than outer diameter 94 of annular rim 63. Impressed indentations 67 form as endcap 47 moves proximally forward as the nut 65 is tightened so that the endcap outer wall 69 can encompass annular rim 63 and cause compression of the outer grip member 33 to form a watertight seal upon sufficiently tightening end nut 65.

Figure 11:
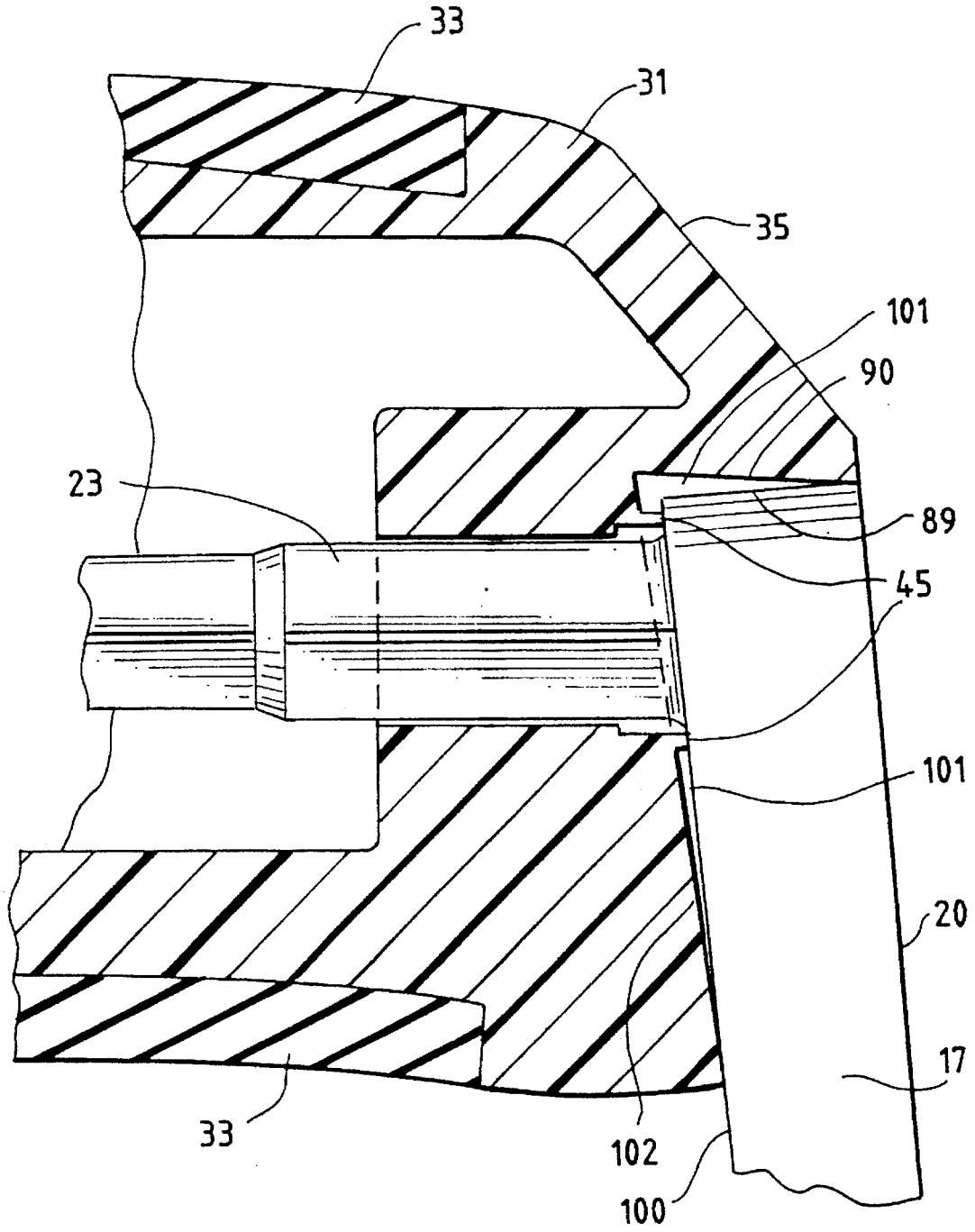
FIG. 11 is a partial cross-sectional view of the front end of the handle and post of FIG. 2 where they are joined.

Referring to FIGS. 3 and 11, inner core 31 also terminates proximally in a front receiving surface 102 below lip 35 and mounting hole 39. Surfaces 89 and 90 are not parallel and 102 and 100 are not parallel so as to create a void volume 101. As handle core 31 is advanced on the proximate portion 23 of the tang, crushing takes place at the interface of surfaces 89 to 90, 100 to 45 and 100 to 102. Crushing of 45 achieves a seal for the hollow core 31. Crushing of 102 and 90 eliminates an opening where cement and sand may lodge making thorough cleanup difficult while also achieving preloaded structural contact for enhanced handle torque resistance, all without requiring difficult and expensive to hold tolerances.

Referring to FIG. 7, the threads 71 of end nut 65 can be coated with a flowable material 73 to further seal threaded surface 29 of tang 21.

Figure 10:
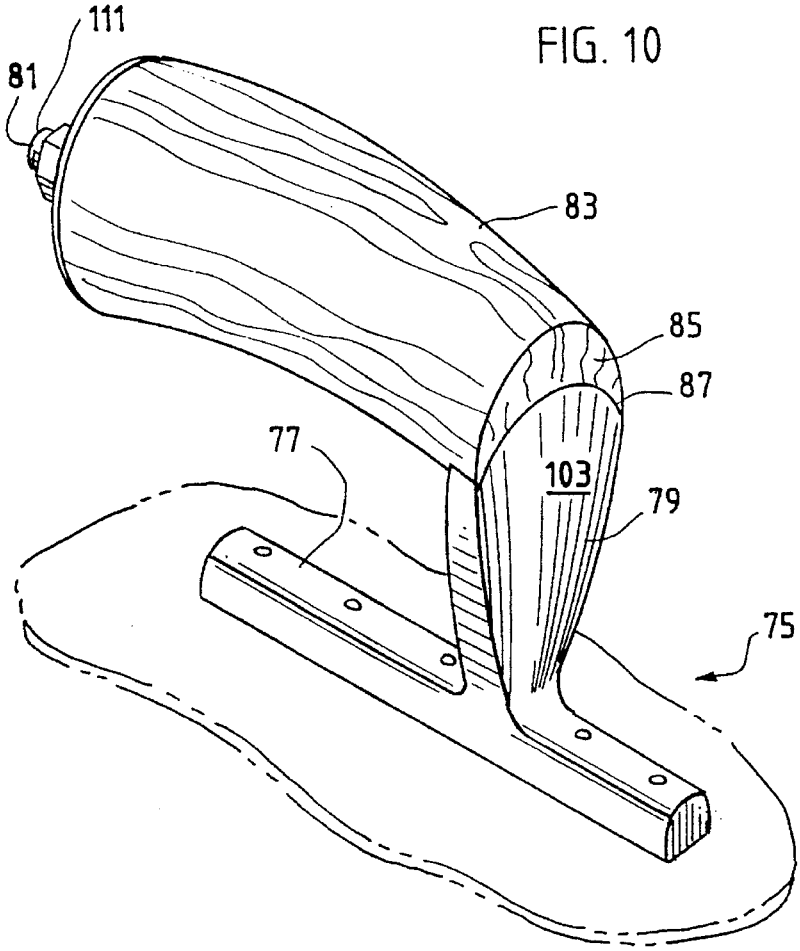
FIG. 10 is a perspective view of another trowel embodiment of the present invention.
Figure 12:
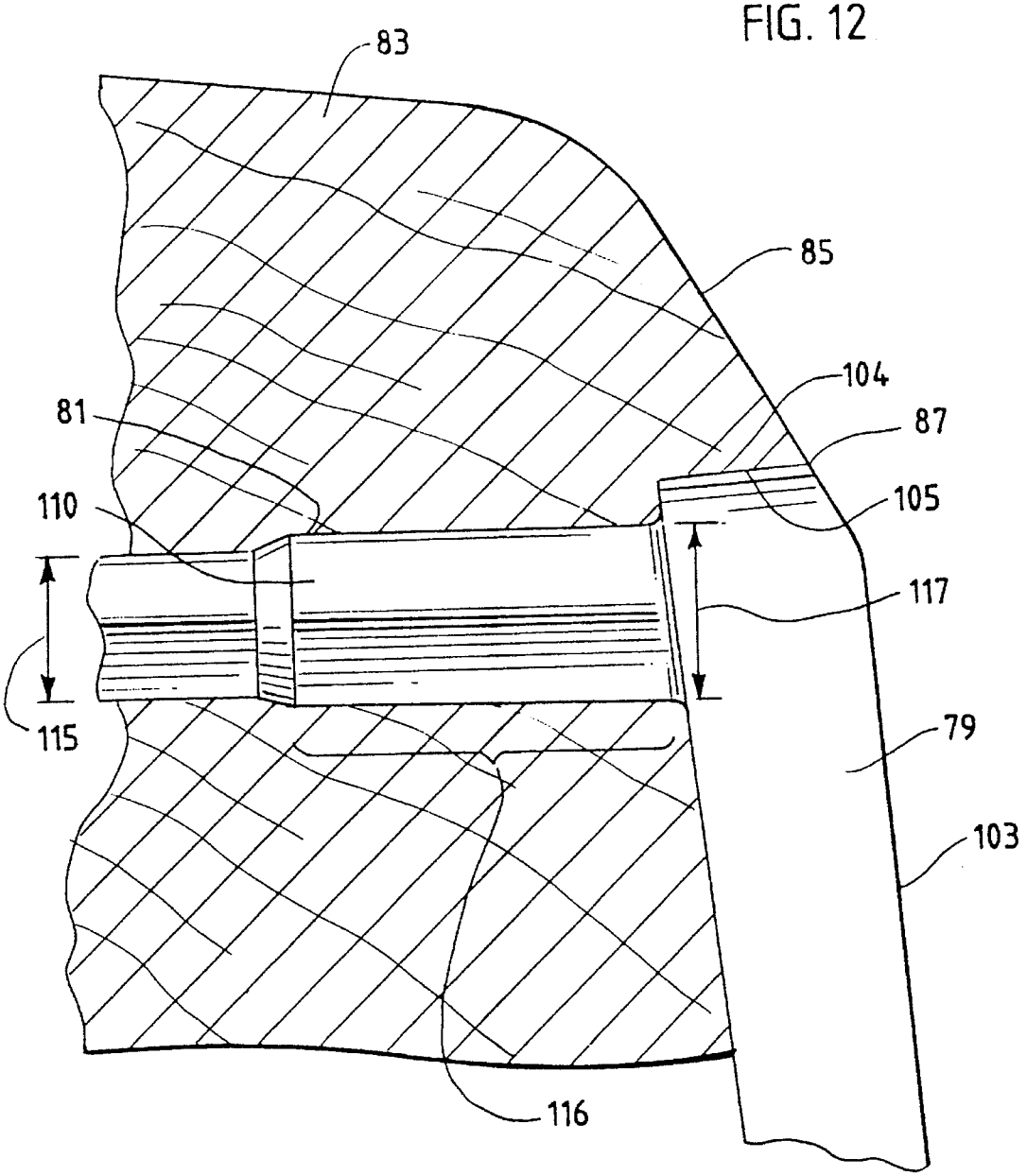
FIG. 12 is a partial cross-sectional view of the front end of the handle and post of FIG. 10 where they are joined.

Referring to FIGS. 10 and 12, an alternative embodiment of the invention includes other handles formed of grippable materials and mounted onto the mounting 75 which is comprised of the rib 77, post 79 and tang 81. Post 79 includes a smooth, cylindrically curved front surface 103 and a top surface 105. Tang 81 includes a proximal section 110 and a distal section 111. Proximal section 110 is disposed adjacent to post 79 and has a square cross-section. The square cross-section allows more torque to be transferred from handle 83 to tang 81. Distal section 111 is cylindrical in shape, terminating in a threaded portion 112.

A solid wooden handle 83 is illustrated mounted onto mounting 75. Handle 83 includes a hollow cavity 115 with a proximal end 116. Cavity end 116 includes a square cross-section 117 for securely receiving proximal end 110 of tang 81.

Handle 83 also includes an angled and rounded arc-shaped lip 85 which has a arc-shaped lower surface 104. The arc-shaped lower surface 104 of lip 85 also encompasses the top surface 105 of post 79. Surface 104 is eccentric to the proximate section 23 of the tang thus allowing for greater torque transfer between the handle 83 and the mounting 75.

Angled and rounded arc-shaped lip 85 also blends to the front of post 79 to form a smooth transition region 87 where the user typically places his thumb. This smooth transition is further facilitated by post front surface 103 curving convexly outward. It is preferred that front surface 103 is cylindrical in shape, rather than conical or compoundly curved, for ease in generating matching shape and dimension in manufacturing a smoothly transitioning mounting 75 and handle 83. Both the material of handle 83 and the metal of post 79 can be further rounded and formed to insure a smooth transition region 87.

While only two preferred embodiments of the invention have been described hereinabove, those of ordinary skill in the art will recognize that either embodiment may be modified and altered without departing from the central spirit and scope of the invention. Thus, the preferred embodiments described hereinabove are to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A trowel, comprising:

a flat blade;

a mounting affixed to the top surface of said blade, said mounting comprising a rib, a post extending upwardly from said rib, said post including a front surface, and a tang extending laterally from said post, said tang having a proximal section and a threaded distal section;

a handle secured to said tang, said handle including (i) an outer grip member formed of a first thermoplastic rubber material and providing a grip surface of a first coefficient of friction with the user's hand;

(ii) a hollow inner core formed of a second plastic material and including (a) a mounting hole for receiving said proximal section of said tang;

(b) a lip angled and rounded so as to provide a flush transition between said post front surface and said inner core, said second plastic material providing a surface having a second coefficient of friction with the user's hand;

(c) an end region, distal from said mounting hole and sufficiently thin so as to provide a deformable wall to axial pressure;

(d) a radial channel within said end region;

(e) an annular rim terminating said inner core;

(iii) an endcap formed of a plastic material, said endcap including (a) an endcap hole for receiving said threaded distal section of said tang;

(b) a conically shaped receiving surface surrounding said endcap hole;

(c) an inner rib structure having a plurality of inner ribs, wherein (1) each said rib includes a rib contact region for contact with said annular rim, said rib contact region pressing into and deforming said rim upon forcing said endcap against said rim and making sealing contact with said outer grip member; and (2) some of said ribs include a spring tab which extends outwardly and is received by said radial channel of said handle end region;

(iv) an end nut threadable onto said threaded distal section of said tang for forcing said endcap against said annular rim.

2. The trowel of claim 1 wherein said mounting hole surfaces include at least one deformable rib extending along said longitudinal mounting hole axis.

3. The trowel of claim 1 wherein said mounting hole is surrounded by a raised deformable annular ring which extends proximally from said inner core.

4. The trowel of claim 1 wherein said cross-sectional shapes of said mounting hole and said proximal section of said tang are square.

5. The trowel of claim 1 wherein said cross-sectional shapes of said mounting hole and said proximal section of said tang are non-circular.

6. A trowel, comprising:

a flat blade;

a mounting affixed to the top surface of said blade, said mounting comprising a post extending upwardly from said top surface, said post including a front surface, and a tang extending laterally from said post, said tang having a proximal section;

a handle secured to said tang, said handle including a proximally located mounting hole surface having a mounting hole for receiving said proximal section of said tang, said mounting hole surface extending longitudinally into said handle a distance sufficient to support said tang and provide strength against torquing forces;

wherein said mounting hole surface includes at least one deformable rib extending longitudinally into said handle.

7. The trowel of claim 6 wherein said mounting hole is surrounded by a raised deformable annular ring which extends proximally from said inner core.

8. The trowel of claim 6 wherein said cross-sectional shapes of said mounting hole and said proximal section of said tang are square.

9. The trowel of claim 6 wherein said cross-sectional shapes of said mounting hole and said proximal section of said tang are non-circular.

10. The trowel of claim 6 wherein said handle includes an inner core and an outer grip member, said outer grip member having a second coefficient of friction different from the inner core.

11. The trowel of claim 6 wherein said handle is formed from plastic.

12. A trowel, comprising:

a flat blade;

a mounting affixed to the top surface of said blade, said mounting comprising a post extending upwardly from said top surface, said post including a front surface, and a tang extending laterally from said post, said tang having a proximal section;

a handle secured to said tang, said handle including a proximally located mounting hole for receiving said proximal section of said tang; and a raised deformable member disposed adjacent said mounting hole and extending proximally from said handle.

13. The trowel of claim 12 wherein said mounting hole is defined by at least one deformable rib extending longitudinally into said handle.

14. A trowel, comprising:

a flat blade;

a mounting affixed to the top surface of said blade, said mounting comprising (i) a rib, (ii) a post extending upwardly from said rib, said post including a top surface, a front surface, and a rear surface, a portion of said top surface being disposed along a first plane, and (iii) a tang extending laterally from said post rear surface, said tang having a section proximal and distal to said post; and a handle secured to said tang, said handle including a proximal and a distal end, and having a proximally located lip, said lip having an inner surface extending inwardly along a second plane disposed relative to said first plane and forming a void volume with respect to said portion of said top surface of said post, said lip further including a front outer surface disposed flush with said post front surface.

15. The trowel of claim 14 wherein said arc-shaped lip encompasses said top surface of said post.

16. The trowel of claim 14 wherein said arc-shaped lip is eccentric to said proximal section of said tang.

17. The trowel of claim 14 wherein said post front surface is cylindrically-shaped and curves convexly outward.

18. The trowel of claim 14 wherein said front lip terminates proximally with a flat, arc-shaped surface.

19. A trowel, comprising:

a flat blade;

a mounting affixed to the top surface of said blade, said mounting comprising a rib, a post extending upwardly from said rib, said post including a front surface, and a tang extending laterally from said post, said tang having a proximal section and a threaded distal section;

a handle secured to said tang, said handle including a inner core with outer diameter and a surrounding outer grip member;

an endcap including (i) an endcap wall with an inner and outer diameter, said endcap wall inner diameter being larger than said inner core outer diameter;

(ii) an endcap hole for receiving said threaded distal section of said tang; and (iii) a conically shaped receiving surface surrounding said endcap hole;

means threadable onto said threaded distal section of said tang for pressing against said conical endcap receiving surface and forcibly sealing said endcap wall against said outer grip member material while sealing said attachment means to said endcap.

20. The trowel of claim 19 wherein said inner core includes a radial channel, said endcap includes an inner rib structure having a plurality of radially disposed inner ribs where a majority of the ribs include an outwardly extending spring tab, and said channel receives said tabs.

21. The trowel of claim 19 wherein said endcap includes an inner rib structure having a plurality of inner ribs, and said handle inner core terminates in a deformable annular rim, and each said rib includes a rib contact region for contact with said annular rim, said rib contact regions impressing into and deforming said rim upon forcing said endcap against said inner core rim and allowing said endcap wall to forcibly seal against said outer grip member material.

22. The trowel of claim 19 wherein said attachment means is comprised of a flanged end nut.

23. The trowel of claim 19 wherein said attachment means is comprised of a nut and washer combination.

24. A tool handle for use with a tool having a blade, comprising:

a mounting affixed to the top surface of a blade of a tool, said mounting comprising a rib, a post extending upwardly from said top surface, said post including a front surface, and a tang extending laterally from said post, said tang having a proximal section and a threaded distal section;

a handle secured to said tang, said handle including (i) an outer grip member formed of a first thermoplastic rubber material and providing a grip surface of a first coefficient of friction with the user's hand;

(ii) a hollow inner core formed of a second plastic material and including (a) a mounting hole for receiving said proximal section of said tang;

(b) a lip angled and rounded so as to provide a flush transition between said post front surface and said inner core, said second plastic material providing a surface having a second coefficient of friction with the user's hand;

(c) an end region, distal from said mounting hole and sufficiently thin so as to provide a deformable wall to pressure;

(d) a radial channel within said end region;

(e) an annular rim terminating said inner core;

(iii) an endcap formed of a plastic material, said endcap including (a) an endcap hole for receiving said threaded distal section of said tang;

(b) a conically shaped receiving surface surrounding said endcap hole;

(c) an inner rib structure having a plurality of inner ribs, wherein (1) each said rib includes a rib contact region for contact with said annular rim, said rib contact region impressing into and deforming said rim upon forcing said endcap against said rim and making sealing contact with said outer grip member; and (2) a majority of ribs include a spring tab which extends outwardly and is received by said radial channel of said handle end region;

(iv) an attachment means threadable onto said threaded distal section of said tang for forcing said endcap against said annular rim.

25. The trowel of claim 24 wherein said mounting hole surfaces include at least one deformable rib extending along said longitudinal mounting hole axis.

26. The trowel of claim 24 wherein said mounting hole is surrounded by a raised deformable annular ring which extends proximally from said inner core.

27. The trowel of claim 24 wherein said cross-sectional shapes of said mounting hole and said proximal section of said tang are square.

28. The trowel of claim 24 wherein said cross-sectional shapes of said mounting hole and said proximal section of said tang are non-circular.

29. The trowel of claim 24 wherein said attachment means is comprised of a flanged end nut.

30. The trowel of claim 24 wherein said attachment means is comprised of a nut and washer combination.

31. A trowel, comprising:

a flat blade;

a mounting affixed to the top surface of said blade, said mounting comprising a rib, a post extending upwardly from said rib, said post including a top surface, a front surface, and a rear surface, and a tang extending laterally from said post rear surface, said tang having a proximal section;

a handle secured to said tang, said handle including (i) a front receiving surface angled to meet and seal at its lower most portion with said rear post surface;

(ii) a mounting hole in said front receiving surface, said hole receiving said proximal section of said tang;

(iii) a raised deformable annular ring surrounding said mounting hole which extends proximally from and seals with said rear post surface;

(iv) an upper lip having a lower surface, said lower surface angled to meet and seal at its most proximal portion with said top post surface, said lip angled and rounded so as to provide a flush transition between said post front surface and said handle.

32. The trowel of claim 31 wherein said upper lip is eccentric to said proximal section of said tang.

33. The trowel of claim 31 wherein said mounting hole surfaces include at least one deformable rib extending along said longitudinal mounting hole axis.

34. The trowel of claim 31 wherein said cross-sectional shapes of said mounting hole and said proximal section of said tang are square.

35. The trowel of claim 31 wherein said cross-sectional shapes of said mounting hole and said proximal section of said tang are non-circular.

36. A tool handle for use with a tool having a flat blade, comprising:

a mounting affixed to the top surface of a blade of a tool, said mounting comprising, a post extending upwardly from said blade, said post including a top surface, a front surface, and a rear surface, and a tang extending laterally from said post rear surface, said tang having a proximal section;

a handle secured to said tang, said handle including (i) a front receiving surface angled to meet and seal at its lower most portion with said rear post surface;

(ii) a mounting hole in said front receiving surface, said hole receiving said proximal section of said tang;

(iii) a raised deformable annular ring surrounding said mounting hole which extends proximally from and seals with said rear post surface; and (iv) an upper lip having a lower surface, said lower surface angled to meet and seal at its most proximal portion with said top post surface, said lip angled and rounded so as to provide a flush transition between said post front surface and said handle.

37. The trowel of claim 36 wherein said upper lip is eccentric to said proximal section of said tang.

38. The trowel of claim 36 wherein said mounting hole surfaces include at least one deformable rib extending along said longitudinal mounting hole axis.

39. The trowel of claim 36 wherein said cross-sectional shapes of said mounting hole and said proximal section of said tang are square.

40. The trowel of claim 36 wherein said cross-sectional shapes of said mounting hole and said proximal section of said tang are non-circular.

41. The trowel of claim 8 wherein said mounting hole surface defines at least one side of said square.

42. A trowel according to claim 12 wherein said deformable member is an annular ring.

43. A trowel, comprising:

a flat blade;

a mounting affixed to the top surface of said blade, said mounting comprising a post extending upwardly from said blade, said post including a front surface and a top surface, and a tang extending laterally from said post along a longitudinal axis;

said top surface located eccentric to said longitudinal axis of said tang; and a handle secured to said tang, said handle including a proximally located lip mounted flush to said post front surface.

* * * * *